US005261618A

United States Patent [19]

Meschi

[11] Patent Number: 5,261,618

[45] Date of Patent: Nov. 16, 1993

[54] DEVICE FOR UNCOILING A PAPER STRIP FROM A COIL

[75] Inventor: Luciano Meschi, Livorno, Italy

[73] Assignee: Industria Grafica Meschi SRL, Livorno, Italy

[21] Appl. No.: 867,507

[22] Filed: Apr. 13, 1992

[30] Foreign Application Priority Data

Apr. 18, 1991 [IT] Italy ..... MI 91 U 000343

[51] Int. Cl.[5] ..... B65H 16/02

[52] U.S. Cl. ..... 242/55; 242/57

[58] Field of Search ..... 242/55, 68.7, 78.7, 242/76, 57

[56] References Cited

U.S. PATENT DOCUMENTS

| | | | |
|---|---|---|---|
| 1,988,255 | 1/1935 | Soons | 242/57 |
| 3,685,760 | 8/1972 | Fedor | 242/78.7 |
| 3,931,940 | 1/1976 | Raighn et al. | 242/56 R |
| 3,994,449 | 11/1976 | Wales | 242/57 |
| 4,298,173 | 11/1981 | Johansson | 242/55 |
| 4,475,696 | 10/1984 | Birch et al. | 242/57 |
| 4,550,883 | 11/1985 | Boss | 242/55 |
| 4,757,951 | 7/1988 | Ludszeweit | 242/68.7 |
| 4,901,935 | 2/1990 | Reist | 242/68.7 |
| 5,101,701 | 4/1992 | Boldrini et al. | 242/57 |
| 5,139,207 | 8/1992 | Meschi | 242/55 |

FOREIGN PATENT DOCUMENTS

| | | | |
|---|---|---|---|
| 228151 | 12/1962 | Austria | 242/68.7 |
| 0004166 | 1/1987 | Japan | 242/57 |
| 2029804 | 3/1980 | United Kingdom | 242/55 |

*Primary Examiner*—Thomas B. Will

*Attorney, Agent, or Firm*—McAulay Fisher Nissen Goldberg & Kiel

[57] ABSTRACT

Device for uncoiling a paper strip (C) from a coil (10), comprising a support (24) for coil (10) for driving paper uncoil therefrom which comprises, downstream of the support (24), belts and roller (24, 26) for receiving and supporting the coil (10*a*) about to be exhausted, allowing the rotation thereof in order not to interrupt the paper strip (C) uncoiling therefrom, and provided with a sensor (28) actuated by the presence of coil (10*a*) and a photodetector (34) for detecting paper presence on the coil (10*a*) for controlling the stopping of the device when the coil (10*a*) is substantially exhausted.

19 Claims, 2 Drawing Sheets

DEVICE FOR UNCOILING A PAPER STRIP FROM A COIL

BACKGROUND OF THE INVENTION

The subject matter of the present invention is a device for uncoiling a paper strip from a coil.

More specifically, the present invention is concerned with a device of the kind forming the subject matter of the publication EP-A-0384533 (U.S. patent application Ser. No. 07/482,229 filed on Feb. 20, 1990 in the name of the present Applicant and now U.S. Pat. No. 5,139,207 entitled "Unwinding Device For Paper Reels" specification and drawings of the above mentioned publication (application), now patent. As noted, the aforesaid U.S. Patent is concerned with an unwinding device for a reel formed of uniformly continuous paper. The device forming the subject matter of the afore-noted U.S. Patent advantageously solved the problems arising from the support and the moving of a paper coil for the uncoiling from the paper coil of a continuous paper strip for the feeding thereof to an apparatus which uses the paper. The last one, for example, had been considered as consisting of a printer, such as a laser printer or the like.

The problems arise chiefly from the not negligible or large size and, above all, from the weight of the coils prior to their uncoiling, as the weight can be of the order of many quintals (hundredweights).

It has been however noticed that when the paper on the paper coil is about to be exhausted its weight is no longer sufficient to assure a proper support on a suitable supporting means controlling contemporaneously the uncoiling thereof and, while such an uncoiling of the paper coil is interrupted, the coil, itself in a substantially unwound condition, is driven to the fore portion of the device by the supporting means themselves, and then stops the feeding of the paper to the printer.

While what is above disclosed is particularly advantageous because it is both not easily forecastable that when uncoiling and movement can occur, and while a sudden stoppage of paper fed to the printer can damage the same, it is desirable to avoid such sudden stoppage.

Further, there is also the noticeable drawback arising from the not negligible unused paper quantity together with the apparent economic damage.

It has been devised, and it is the subject matter of the present invention, to a provide an improved device following the teachings according to the above mentioned patent application which device has been improved by providing it with means and structure for eliminating the above mentioned drawbacks.

The device according to the present invention is thus characterized in that it comprises, providing downstream of the paper coil supporting means in the device of the aforementioned U.S. Patent for controlling the uncoiling of the paper from the paper coil of the paper strip for feeding the printer, novel means for receiving and supporting the coil about to be exhausted, while allowing the rotation and uncoiling of the coil in order not to interrupt the paper strip uncoiling therefrom, and further providing sensing means which are actuated by the presence of the coil and sensing means for sensing the presence of paper on the coil to control the device stopping the uncoiling of the paper coil when the coil is substantially exhausted.

The features as well as the advantages of the device according to the present invention will become clearer from the following detailed description of a not limiting embodiment thereof, which will be made with reference to the accompanying drawings, in which:

DESCRIPTION OF THE PREFERRED EMBODIMENT

Figure 1:
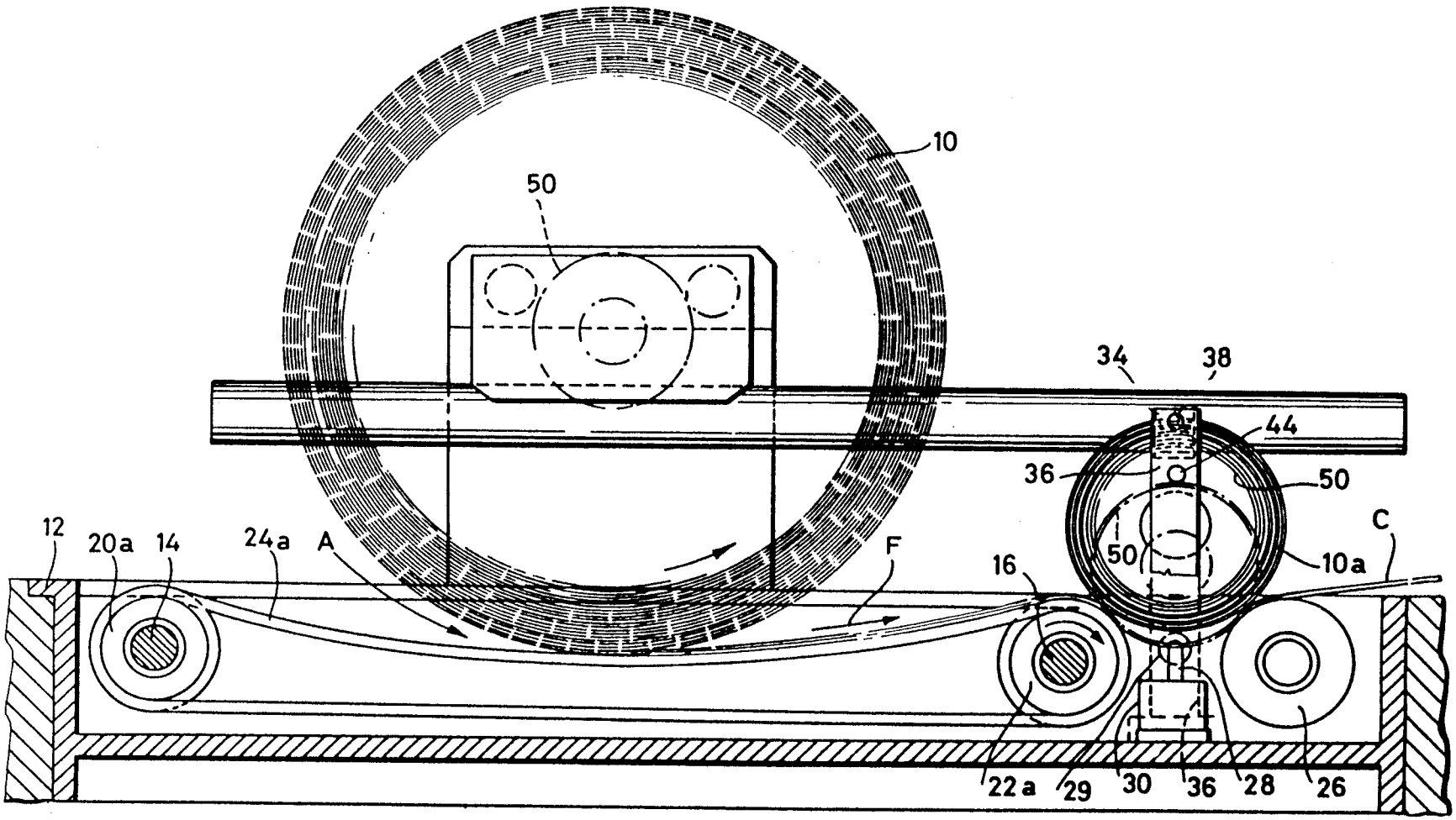
FIG. 1 is a lateral schematic view, partially in cross-section, of the device according to the invention in the subsequent operating steps thereof.

Referring to the above mentioned figures, the device according to the invention, in the considered embodiment, is provided for uncoiling paper from a the paper coil from a core 50, the paper coil being generally indicated by the numeral 10 and depicted by broken or discontinuous lines and comprises a fixed frame 12 for supporting at each end thereof an axle with a roller 14, 16 and the second axle or roller 16 is operatively connected with a driving motor 18 (see FIG. 2), for example through a well known motion transmission means also provided for controlling the rotational speed of the roller 16, such as for example a ratiomotor (not depicted in detail).

On each roller 14 and 16, there is mounted a plurality of sprockets, for explanation purposes four in number for each roll and the sprockets indicated by the references 20*a*, 20*b*, 20*c* and 20*d* are provided for the roller 14 and sprockets 22*a*, 22*b*, 22*c*, and 22*d* are provided for the roller 16. Every sprocket pair, i.e. the pairs (20*a*, 22*a*), (20*b*, 22*b*), (20*c*, 22*c*) and (20*d*, 22*d*) supports a closed loop belt, indicated by the numerals 24*a*, 24*b*, 24*c* and 24*d*, which is moved according to the direction indicated by the arrow F by the motor means 18. From FIG. 1 it is also possible to appreciate that the movement of the belts 24 according to the direction of the arrow F causes an uncoiling of the paper web or strip C from the coil 10 without needing that it is in any way separately supported at the axis thereof. The paper coil 10 is supported on the belts 24.

For purposes of explanation and clarity, as explained heretofore, the essential features regarding the support of the coil 10 and the rotation thereof as driven by the belts 24 for uncoiling the paper web C, has been explained. For the other features, not specially pertaining to the present invention, reference is made to the above mentioned patent.

Figure 2:
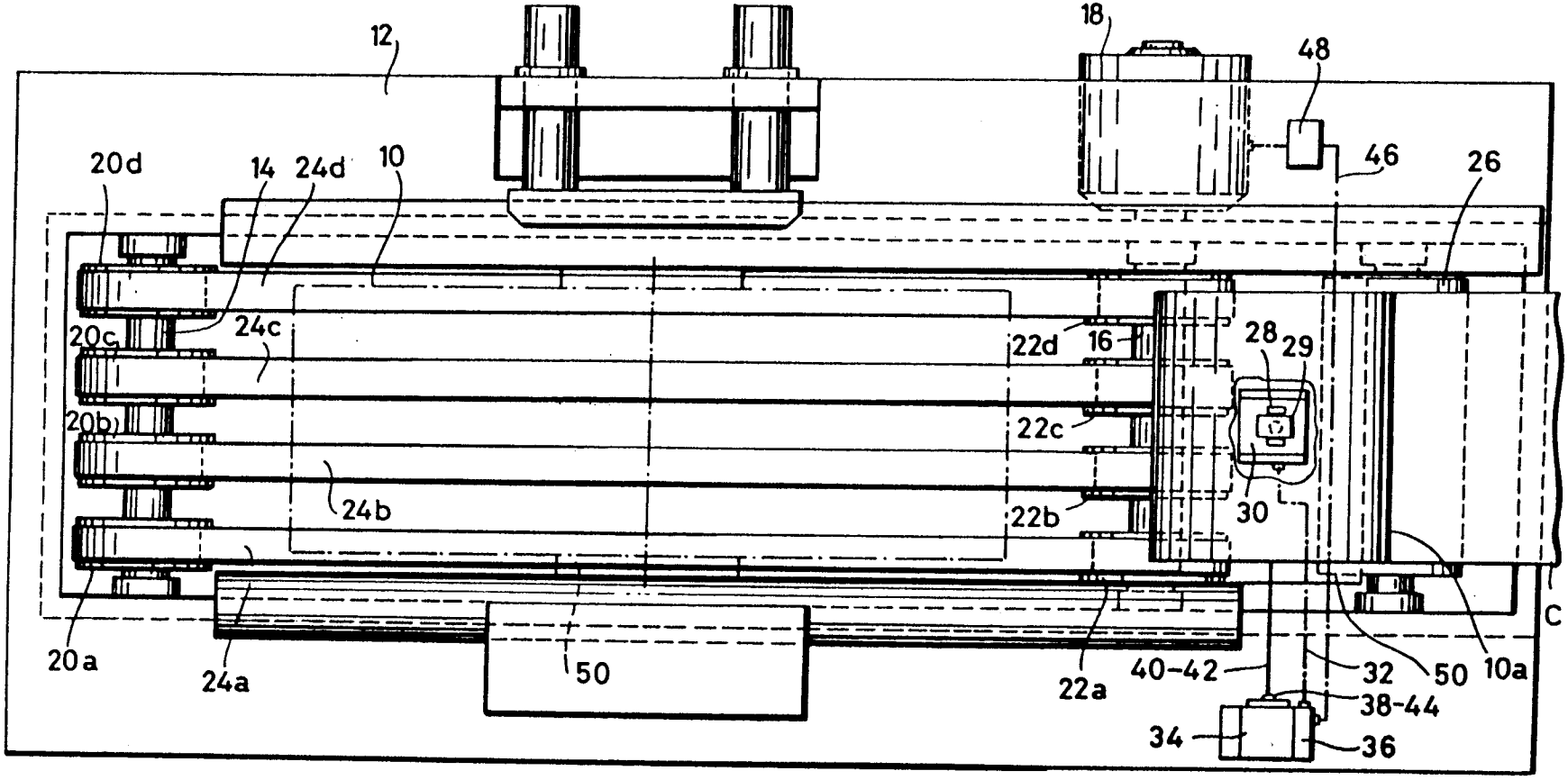
FIG. 2 is a schematic top view of the device in the FIG. 1.

When the coil 10 is about the be exhausted, the weight thereof is no longer sufficient to maintain it in the position depicted in FIGS. 1 and 2 to allow the continuous uncoiling of the paper web C. Therefore, the coil 10, as a result of the action of the belts 24 themselves, the coil 10 is advanced to the downstream or the fore portion of the device where it is also depicted and indicated by the numeral 10*a* in FIG. 1. In this position, just downstream of the above mentioned belts 24 and beyond axle and roller 16, there are provided, according to the present invention, means to support the coil 10*a* while allowing the rotation thereof and then to continue to enable coil 10*a* to feed the printer with the paper strip C. Also provided, as will be hereinafter disclosed, are sensing means for driving the device and stopping the device when the coil 10*a* is substantially exhausted and thereby increase the quantity of paper removed from the original paper coil 10. Referring now more particularly to FIG. 1, the coil 10*a* is supported at one side, the upstream side, by the belts 24, in order to maintain coil 10*a* and in rotation the coil 10*a* is supported at the other side, the downstream side, by an idle roller 26 which is supported by the frame 12 for helping in allowing the rotation of the coil 10*a*.

As best seen in FIGS. 1 and 2, on the bottom of the frame 12, in substantially central position, a microswitch 28 is provided which is supported by a strut 30, and coil 10*a* abuts on strut 30 for controlling the switching on of switch 28. On the end of the movable member of the microswitch 28 which end is engaged by the coil 10*a* there is mounted a small roller 29 allowing the rotation of the above mentioned coil and the advancing of the paper strip C. The microswitch 28 is connected, by means of a connection 32 (FIG. 2), to sensing means 34 which in the considered exemplary embodiment, consists of a per se known reflection photodetector. The sensing means 34 is supported by a strut 36 which is arranged in a substantially lateral position in the frame 12. The height of the strut 36 is properly selected in order to have the photodetector 34 sending or transmitting, by means of an emitter 38, a transmitted light ray 40 properly downwardly inclined in the direction of the residual paper still present on the coil 10*a*, such an emission producing a reflected ray 42 which is reflected from core 10*a* and is forwarded to the receiver 44 of the photodetector 34. While coil 10*a* is maintained in this condition, i.e. there is reflection of the ray 40 and while there still is some paper present on the coil 10*a*, the photodetector 34 does not affect the powering conditions of the motor 18 which so remains rotating and driving the uncoiling of the paper strip C from the coil 10*a* and feeding to the printer. When the paper on coil 10*a* is completely exhausted, so that there is no longer any paper thereon, this ceases the above-mentioned reflection sent from the photodetector 34 which affects its own sending state, by means of a connection 46 on which is inserted a proper control member, as for example an electromagnetic switch 48 or control means to control the operation and shut off of motor 18 to provide a proper control signal to the motor 18 controlling the stopping thereof and thus a control and stopping of the device itself. Then it is provided to remove the core 50 of the coil 10*a* from the device itself and to relocate or place a new coil 10 onto belts 24*a*, 24*b*, 24*c* and 24*d* for a subsequent operating cycle. From the above, the self evident advantages arising from the use of the device according to the present invention will be readily apparent both in properly economic terms because the paper use is complete, and because the obtained operation, specifically, as regards the final step thereof, is free from damaging effects with respect to the printer. At last, it is clear that variations and/or changements can be made to the device according to the present invention without however coming out of or departing from the coverage thereof.

I claim:

1. An unwinding device for uncoiling a reel having thereon a continuous paper strip forming a coil, the coil uncoiling from a first state wherein a substantial portion of the strip forms the coil to a second state wherein a minor portion of the strip remains on the reel to be uncoiled, comprising:

belt means formed of a material having some resilience against stretch for abutting against the coil from which the paper is to be uncoiled when said coil is in said first state;

belt support means for supporting said belt means so as to define a front end and a rear end, said paper being uncoiled over said front end;

means for driving said belt means having a predetermined and adjustable speed while said belt means makes frictional contact with a surface portion of said coil;

separate support means located downstream of said front end of said belt means to cooperate with said front end of said belt means to form a receiving area which supports said coil when it is in said second state wherein said coil moves from said belt means to said receiving area when said coil uncoils from said first state to said second state and wherein said front end of said belt means continues to cause said coil to be uncoiled so that uncoiling of said continuous paper strip is not interrupted;

sensor means located near said receiving area responsive to the presence of said coil in said receiving area for controlling said belt driving means; and detecting means responsive to said sensor means for detecting the presence and absence of paper on said reel at said receiving area for stopping the uncoiling of the reel when the paper is exhausted from said reel.

2. The device according to claim 1, wherein said separate supporting means is an idle roller.

3. The device according to claim 1, wherein said separate supporting means is an idle roller and said belt support means includes a downstream roller juxtaposed to said idle roller to form said receiving area between said idle roller and said downstream roller.

4. The device according to claim 2, including a frame, a pair of supporting rollers for said belt support means, and said pair of supporting rollers and said idle roller being supported by said frame.

5. The device according to claim 3, including a frame, said downstream roller and said idle roller being supported by said frame.

6. The device according to claim 1, wherein said sensor means includes switch means and sensing means activatable in response to the presence of said coil in said receiving area, said switch means being responsive to the presence of said coil in said receiving area for activation of said sensing means.

7. The device according to claim 5, wherein said sensor means includes switch means positioned between said front end of said belt means and said idle roller, said switch means including a roller engageable with a surface portion of said coil in said receiving are.

8. The device according to claim 2, wherein said sensor means includes a switch means positioned between said front end of said belt means and said idle roller, said idle roller being supported by a frame and engaged with a surface portion of said coil, and said switch means including a roller between said front end of said belt means and said idle roller.

9. The device according to claim 1, wherein said detecting means includes means for detecting the presence of paper on said reel.

10. The device according to claim 1, wherein said sensor means includes a microswitch and sensing means responsive to the activation of said microswitch.

11. The device according to claim 10, wherein said detecting means includes a photodetector for detecting the presence of paper on said reel and motor switch means coupled with a driving motor for said driving means, said motor switch means being responsive to said photodetector for rendering said motor inoperative when said photodetector detects the absence of paper on said reel.

12. The device according to claim 1, wherein said detecting means for detecting the absence of paper on said reel controls said belt driving means for actuating a driver therefor and sending thereto a stopping signal when the paper on the reel is exhausted.

13. The device according to claim 1, wherein said sensor means includes a roller on the end of a movable member for engaging the paper on said reel freely turnable for allowing the rotation of said reel and the advancement of the paper strip.

14. The device according to claim 4, wherein said sensor means includes a small roller on the end of a movable member of a microswitch for engaging the paper strip on the reel freely turnable for allowing the rotation of the reel and the advancement of the paper strip.

15. The device according to claim 3, including a frame, said idle roller being supported by said frame downstream of said belt means for supporting said coil proximate to said sensor means.

16. The device according to claim 1, wherein said detecting means for detecting the presence of paper on said reel is connected to said sensor means for actuating said belt means and is preset for sending thereto a stopping signal when the paper strip on said reel is exhausted.

17. The device according to claim 1, wherein said sensor includes switch means positioned between said front of said belt means and said separate support means on a frame of the device, said switch means, said separate support means and said front end being engaged with a surface portion of the paper strip on said reel.

18. The device according to claim 1, wherein said detecting means includes a photodetector and an electromagnetic switch coupled with a motor of said belt driving means.

19. The device according to claim 18, wherein said photodetector includes a transmitter and a receiver for directing rays to the strip on said reel for detecting the absence of paper on said reel for activating said electromagnetic switch for stopping said motor.

* * * * *